US005867914A

United States Patent [19]

Watson et al.

[11] Patent Number: 5,867,914

[45] Date of Patent: Feb. 9, 1999

[54] DRAWING DEVICE WITH MULTIMEDIA ENHANCEMENT

[75] Inventors: James E. Watson, Bryan, Ohio; Ralph Beckman, Providence, R.I.; Henry Sharpe, III, Saunderstown, R.I.; Brian R. Jones, Exeter, R.I.; Larry E. Miller, Bryan, Ohio; Stephen Schwartz, Providence, R.I.

[73] Assignee: The Ohio Art Company, Bryan, Ohio

[21] Appl. No.: 599,221

[22] Filed: Feb. 9, 1996

[51] Int. Cl.[6] ..... B43L 13/00

[52] U.S. Cl. ..... 33/18.1

[58] Field of Search ..... 33/18.1; 434/409, 434/410; 273/240

[56] References Cited

U.S. PATENT DOCUMENTS 3,055,113 9/1962 Grandjean ..... 33/18

3,760,505 9/1973 Clark ..... 33/18 R 5,321,891 6/1994 Arad et al. ..... 33/18.1

FOREIGN PATENT DOCUMENTS 228899 9/1989 Japan ..... 33/18.1

*Primary Examiner*—G. Bradley Bennett

*Attorney, Agent, or Firm*—Chapman and Cutler

[57] ABSTRACT

A multimedia enhancement for an amusement device includes a sound synthesizer for creating a user perceptible signal, such as an audio signal, in response to selective actuation of the controls of the amusement device. The amusement device includes a screen for displaying a viewer perceptible image and a pair of rotary control knobs operatively associated with rotary switches and a selectably actuable on-off switch to provide amusing sounds and feedback indicative of the operator's use of the control knobs. The sound synthesizer is programmed to also create one of a series of sounds from a plurality of families of sounds in a predetermined sequence in response to actuation of the control elements by the user or randomly.

22 Claims, 6 Drawing Sheets

DRAWING DEVICE WITH MULTIMEDIA ENHANCEMENT

FIELD OF THE INVENTION

This invention relates to an amusement device, and, in particular, to an improved design including a selectively actuable multimedia enhancement.

BACKGROUND OF THE INVENTION

Amusement devices, such as drawing devices for use generally by children of the type contemplated by the present invention have been developed, such as the tracing device shown in U.S. Pat. No. 3,760,505 assigned to the assignee of the present invention. Generally speaking, prior art drawing devices included a fluid-tight compartment having a transparent upper surface. The transparent surface is preferably made of glass to avoid scratching by a below mounted, user controllable stylus. The fluid-tight container is filled with a fluid or fine powder, such as a fine metallic powder, which will be attracted to and coat the inner surface of the transparent plate rendering it opaque. A pulley and rod mechanism mounts a stylus for contact with the inside surface of the transparent plate so that movement of the stylus by the operator causes a dislocation of the fluid on the inner surface of the plate, which is visible to the user to form a sketch or drawing or picture.

An improvement to these type of amusement devices is shown in U.S. Pat. No. 3,760,505, also assigned to the Assignee of the present invention, which added a number of safety features to ensure that the fluid material would not leak from the fluid-tight container and to prevent broken glass from escaping the event the glass plate was broken or damaged thereby improving the safety of the drawing device for use by children.

U.S. Pat. No. 5,321,891 also assigned to the Assignee of the present invention, includes several additional improvements which provide added useful features to enable the cursor to be moved out of contact with the glass surface to add greater flexibility to the type of drawings that can be created.

SUMMARY OF THE PRESENT INVENTION

The present invention relates to an improvement in an amusement device to provide additional useful or amusing features.

An object of the present invention is to provide a drawing device, including a fanciful exterior design and shape.

Another object of the present invention is to provide an improved drive chain and support assembly for the movable drawing elements of the present invention.

Still another object of the present invention is to provide a drawing device having multimedia or audio-visual capabilities.

These and other objects of the present invention are provided by a drawing device having a free-form outer configuration surrounding a fluid-tight inner container having a transparent top surface. A pulley system within the container mounts a pair of rods which support a cursor or stylus in engagement with the under side of the transparent surface. A pair of control knobs extending through openings in the container permit movement of the control rods in such a fashion to allow drawings of straight lines, curved lines or a combination thereof, to be created on the under surface of the clear top to create a viewable drawing. Each of the control knobs carries an electrical contact member to create a rotary switch for making intermittent contacts with an electrical circuit, including a programmable sound synthesizer to output electrical signals which are converted by a speaker to audible sounds.

BRIEF DESCRIPTION OF THE DRAWINGS

The above-mentioned and other features, objects and advantages and the manner of attaining them are described more specifically below by reference to the embodiment of this invention shown in the accompanying drawings, wherein.

DETAILED DESCRIPTION OF THE PREFERRED EMBODIMENT

Figure 1:
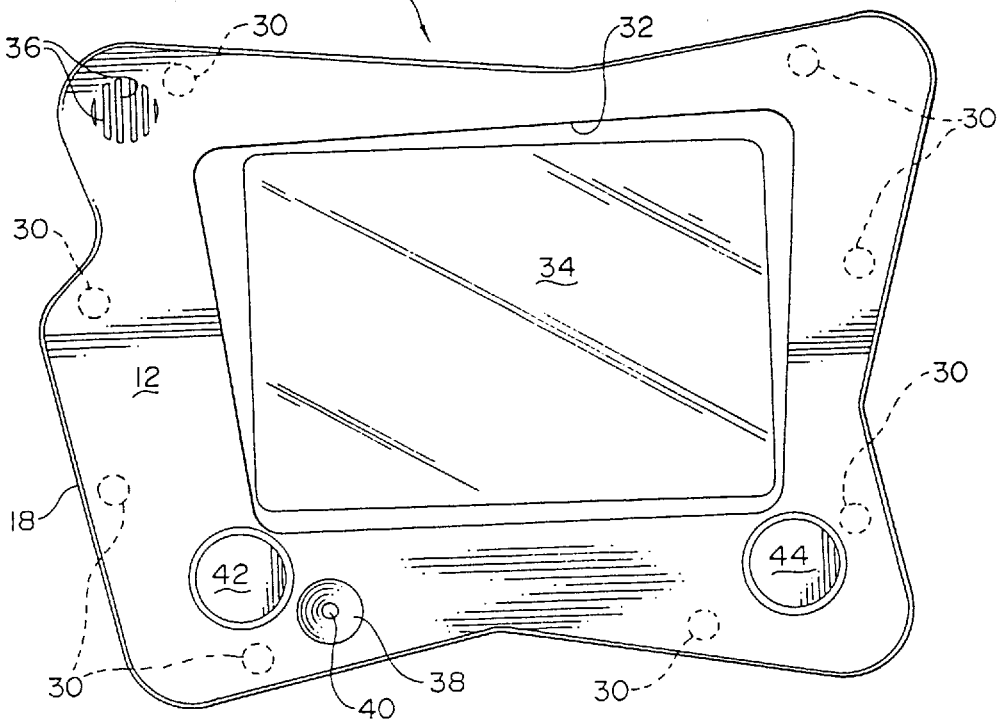
FIG. 1 is a top plan view of the improved drawing device according to this invention.
Figure 2:
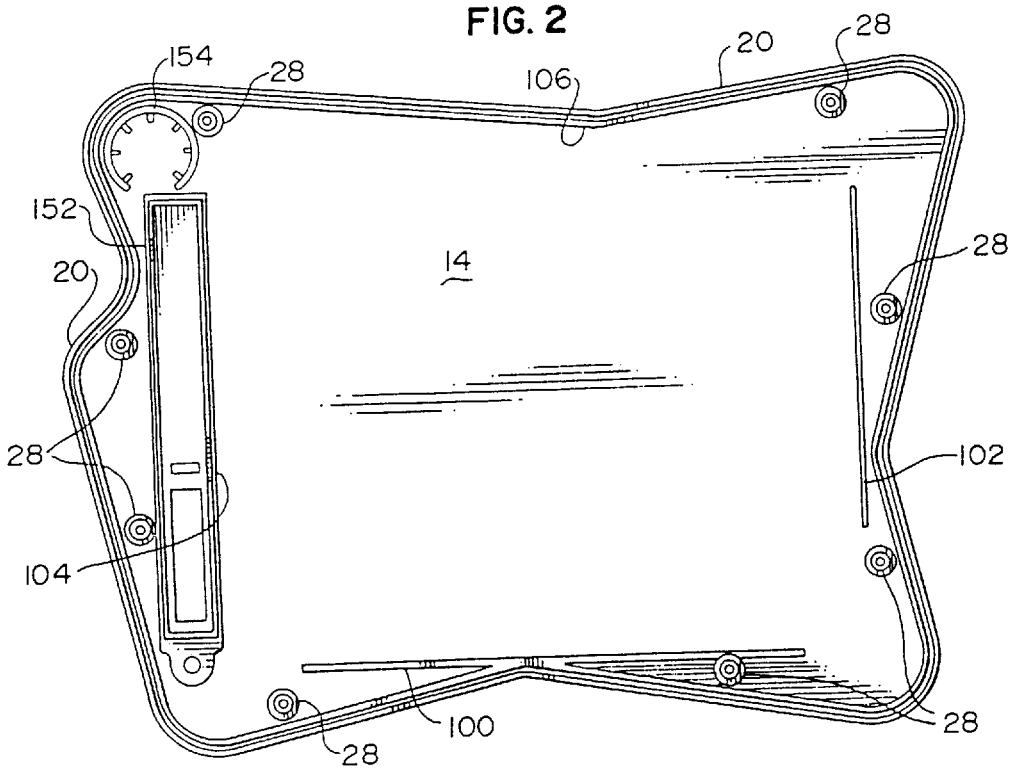
FIG. 2 is a top plan view of the outer base element of the device shown in FIG. 1.
Figure 3:
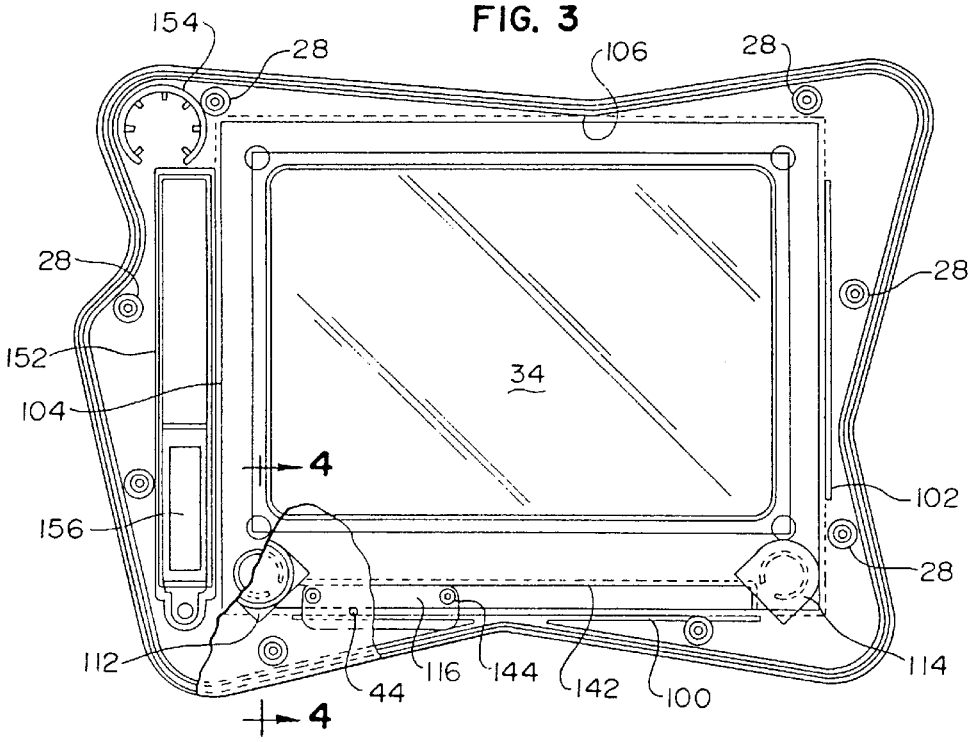
FIG. 3 is a top view of the assembled drawing device of the present invention with the top outer cover substantially removed.
Figure 6:
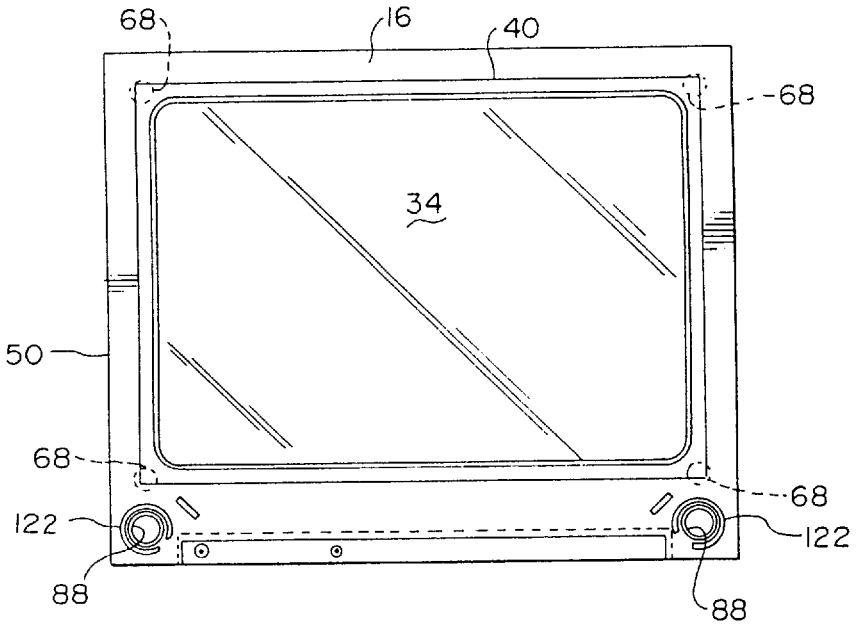
FIG. 6 is a top plan view of the inner cover portion of the present invention.
Figure 7:
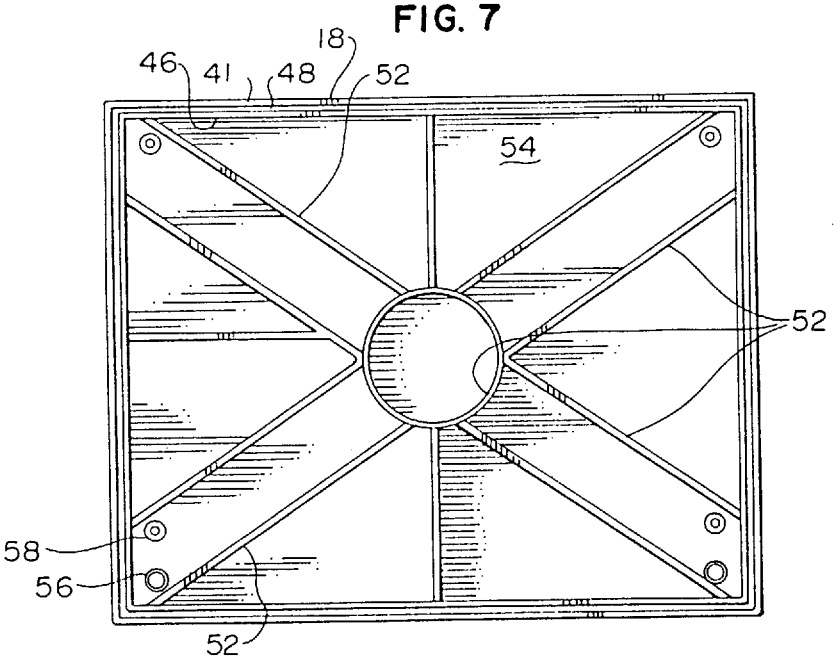
FIG. 7 is a top plan view of the inner base portion of the present invention.

Referring to FIG. 1 of the drawings, the amusement device of the present invention, generally designated 10 in FIG. 1, includes an outer top cover 12 and an outer bottom cover or outer base 14. An inner top cover or inner cover 16 is shown in FIG. 6 and an inner base 18 is shown in FIG. 7 are assembled to form an inner fluid-tight assembly. Generally speaking, after assembly, the inner cover 16 and inner base 18 house the mechanical elements of the drawing device 10 as will be described in greater detail hereinafter and the outer cover 12 and outer base 14 contain both the inner assembly and the electrical elements, as described in greater detail hereinafter.

Figure 4:
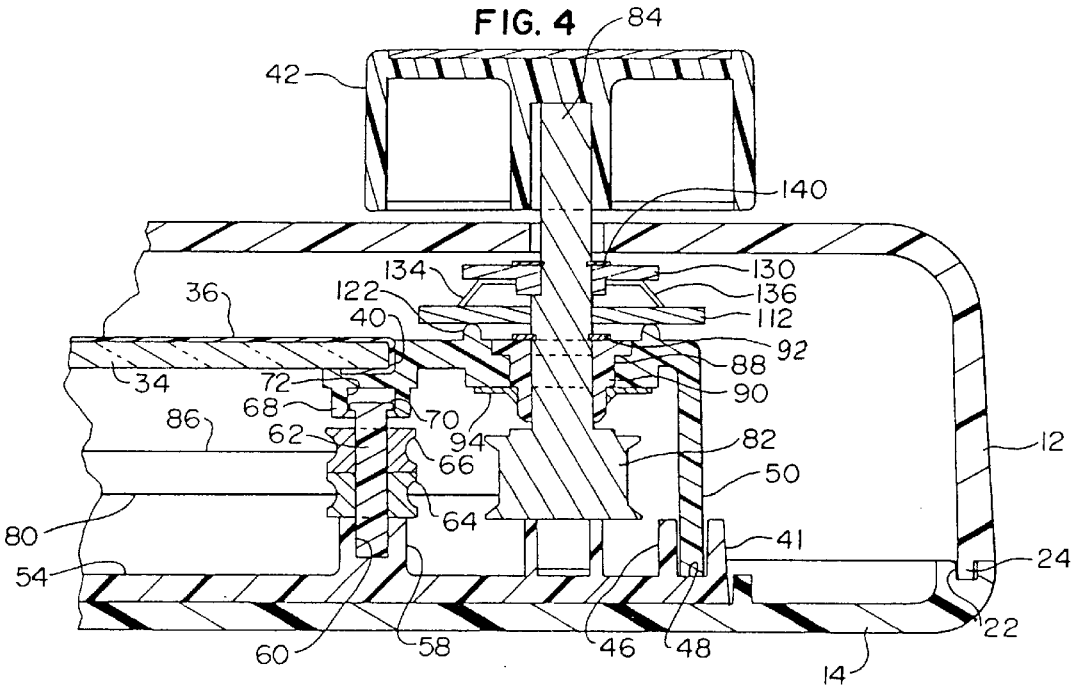
FIG. 4 is an enlarged and expanded side view taken along lines 4—4 of FIG. 3 showing the control knob mounting arrangement.

The outer top 12 and the outer base are complementary free-form elements preferably molded of plastic or the like to form the outer assembly of the drawing device 10. In particular, the outer cover 12 includes a generally smooth, contoured outer perimeter 18, as shown in FIG. 1 in the drawings, although the particular shape that is chosen is arbitrary. The outer base 14 includes a similar perimeter 20 in which an upwardly curved perimeter includes a notch 22 for receiving a depending flange 24 of the outer cover, as best seen in FIG. 4. The outer cover 18 and outer base 20 may be secured in any suitable manner such as by adhesive, ultrasonic welding, snapfit, etc. In addition, a plurality of bosses 28 are formed or molded on the outer base within the perimeter 20 and mate with a similar number of aligned bosses 30 on the underside of the top surface of the outer cover 12, as shown in FIG. 1. These bosses 28 and 30 engage one another and provide additional support and resiliency to the outer assembly of the drawing device 10 and may also be used for additional adhesive or snapfit securement.

The outer cover 12 also includes a generally four-sided randomly shaped opening 32, which again is arbitrary in shape but preferably sized to permit the viewing of the rectangular screen 34, as will be described in greater detail hereinafter. In addition, the top cover includes a plurality of parallel slots 36 which act as a speaker grill. A spherical depression 38 is provided for a momentary type, on-off switch 40 which will be described in detail with respect to the schematic of FIG. 10. A left, cursor control knob 42 and a right, cursor control knob 44 are rotatably mounted for selective actuation by the user of the drawing device in a similar manner as described in the above-referenced patents assigned to the Assignee of the present invention and which are incorporated herein.

The opening 32 in the outer cover 12 may include a transparent glass or plastic closure through which the screen 34 is visible. The screen 34 is preferably made of glass and covered by a thin film of clear, resilient plastic 36 to prevent accidental loss of glass pieces in the event the glass plate 34 is damaged or broken accidentally, such as if the drawing device 10 were stepped on or accidentally dropped.

The screen or glass plate 34 is mounted on the inner cover 16 which is preferably manufactured of suitable material such as molded plastic. The glass plate 34 is generally rectangular in shape and fits within a rectangular groove 40 which is sized to receive the plate 314 with the plastic protective sheet 36 wrapped around the edge of the glass plate 34. The inner cover 16 and inner base 18 include structures for mounting the internal mechanical elements of the drawing device.

In particular, the inner base 18 includes a raised peripheral wall 41 and a raised internal wall 46, parallel to the external wall 41, defining a groove 48 therebetween. The peripheral groove 48 receives a vertically depending flange 50 about the outer periphery of the inner cover 16. In addition, the inner base includes a plurality of ribs 52 for strengthening and adding rigidity to the inner base, two control knob journals 56 and four pulley journals 58. Each of the journals 56 and 58 project upwardly from the bottom wall 54 of the inner base as can best be seen in FIG. 4. Each pulley journal 58 includes a concentric aperture 60 for receiving a shaft 62 which mounts a lower pulley 64 and an upper pulley 66. Similarly, the inner cover includes four top pulley journals 68 which mount the upper ends of the four shafts 62. Each of the shafts 62 may have a flanged upper end 70 which fits within an aperture 72 in each of the upper shaft journals 68.

In this way, four shafts 62 each mount two independently rotatable pulleys 64 and 66 in a rectangular array generally outside or adjacent to the edge of the glass plate 34. The pulleys 64 and 66 support thin cables or rod support filaments 80 and 86 in a manner as shown in U.S. Pat. No. 3,760,505. However, in the above-mentioned patent, the eight pulleys corresponding to pulleys 64 and 66 of the present invention were mounted on eight separate journals and the current design facilitates assembly and cost-reduction in the present design. Also, as described in the aforementioned patent, a pair of rods (not shown) support a cursor which engages the underside of the glass plate 34 to remove and, therefore, create an image in the metallic or other powder on the underside thereof. In the design as shown in FIG. 4, the left knob 42 controls the horizontal travel of the cursor by movement of the rod which carries the cursor in the horizontal direction. The rod support filament 80 shown in FIG. 4 is supported by the lower pulleys 64 and connected to a large pulley 82 mounted on the support shaft 84 for the control knob 42. The rod support filament 80 supports the rod (not shown) that moves the cursor in the generally horizontal direction. Similarly, the rod support filament 86 is supported by the upper pulleys 66 and driven by the right control knob 44 to move the cursor support rod and cursor in the vertical direction. Again, referring to FIG. 4 and to the left control knob 42, the mounting shaft 84 is mounted within journal 56 formed on the inner base in an aperture 88 formed in the inner cover. The pulley 82 and shaft 84 may be integrally molded of plastic or the like and a bushing 90 is fitted within the aperture to support the shaft 84 for rotation and to provide a fluid-tight seal within the assembly of the inner base and inner cover. A first C-clip 92 engages the top of the bushing 90 and a push nut fastener 94 engages the bottom surface near the aperture 88. In this manner, as described, the mechanical elements and control knobs permit the user to make suitable and imaginative drawings by removing the coating off of the inner surface of the glass 34.

The inner assembly of the inner cover 16 and inner base 18 is mounted and aligned by a generally horizontal flange 100, a vertical flange 102, a wall 104 of a battery compartment, and the innermost point 106 on the peripheral wall of the outer cover 12. As positioned, the inner assembly is aligned so that the glass plate 34 is totally visible within the aperture 32 of the outer cover. It should be pointed out that although the inner assembly and glass plate 34 are generally rectangular in shape, many other shapes could be used for an amusement device of this invention which would be at least as economical and possibly more economical. For example, if the pulleys 64 and 62 are arranged in a parallelogram, the drawing device would work in almost an identical manner. The only physical restraint being that opposed, rod support filament segments between the pulleys would have to be the same length in order to cause the cursor to generate a straight line by turning only one of the control knobs 42 and 44. If the opposed filament segments are of different lengths, the cursor would generate curved lines and it may become necessary to add a system to take up slack. Similarly, the knobs need not be placed at the bottom right and left side corners but could be at the top, the middle of the sidewalls, or other convenient locations. Since these various designs are merely choices made by the engineer, designer or manufacturer, no particular design will necessarily have an advantage in its economies and/or production over any other design.

In addition to the overall design and manufacturability of the drawing device as described above, the present invention also contemplates the provision of a multimedia or audio-visual enhancement. The audio-visual enhancement chosen for the design of the present invention generally includes a speaker 110, a pair of control knob PC boards 112 and 114, and a main control panel or PC board 116. Generally speaking, the control knobs 42 and 44 complete a circuit on one of the respective PC boards 112 or 114 which generates one of a random series of sounds selected from one or preferably more families of sounds, through the speaker 110, as will be described in detail hereinafter.

Referring again to FIG. 4, the control knob PC board 112 is supported by a generally C-shaped rib 122 which extends upwardly from the top surface of the inner cover concentric with the shaft 84 of the respective control knob.

Figure 11:
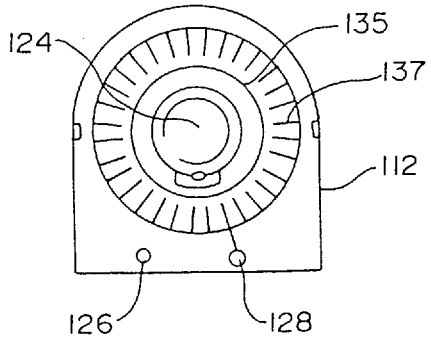
FIG. 11 is a top view of the knob contact printed circuit board of the present invention.

Referring in particular to FIG. 11, the control knob PC board 112 includes an inner aperture 124 for the shaft 84 and a pair of leads 126 and 128. One of the leads 126 is connected to a continuous inner contact member 135 printed on the PC board 112 and the other lead 128 is connected to a plurality of segmented flat foil contacts 137 around the outer periphery of the continuous contact element 130 when the PC board 112 is mounted in its position about the shaft 84. A pair of contact supports 130 and 132 are provided for the shafts of the respective control knobs 42 and 44. Each support 130 and 132 has an insulating center support portion with a D-shaped opening for mounting over the D-shaped upper end of the shaft 84 to insure conjoint rotation with the shaft. A pair of contact fingers 134 and 136 depend from the support elements 130 for engagement with either the continuous inner contact 135 or one of the segmented outer contact elements 137 on the PC board 112 so that a connection is sequentially made and broken between the leads 126 and 128 when the knob is rotated. A second C-clip 140 secures the element 130 on the shaft 84. In this manner, as the user selectively, manually rotates the control knobs 42 and 44 to move the cursor and thereby create a drawing or picture on the screen 34, contact will be alternately made and broken across the leads 126 and 128 of each of the respective control knob PC boards 112 and 114.

Figure 5:
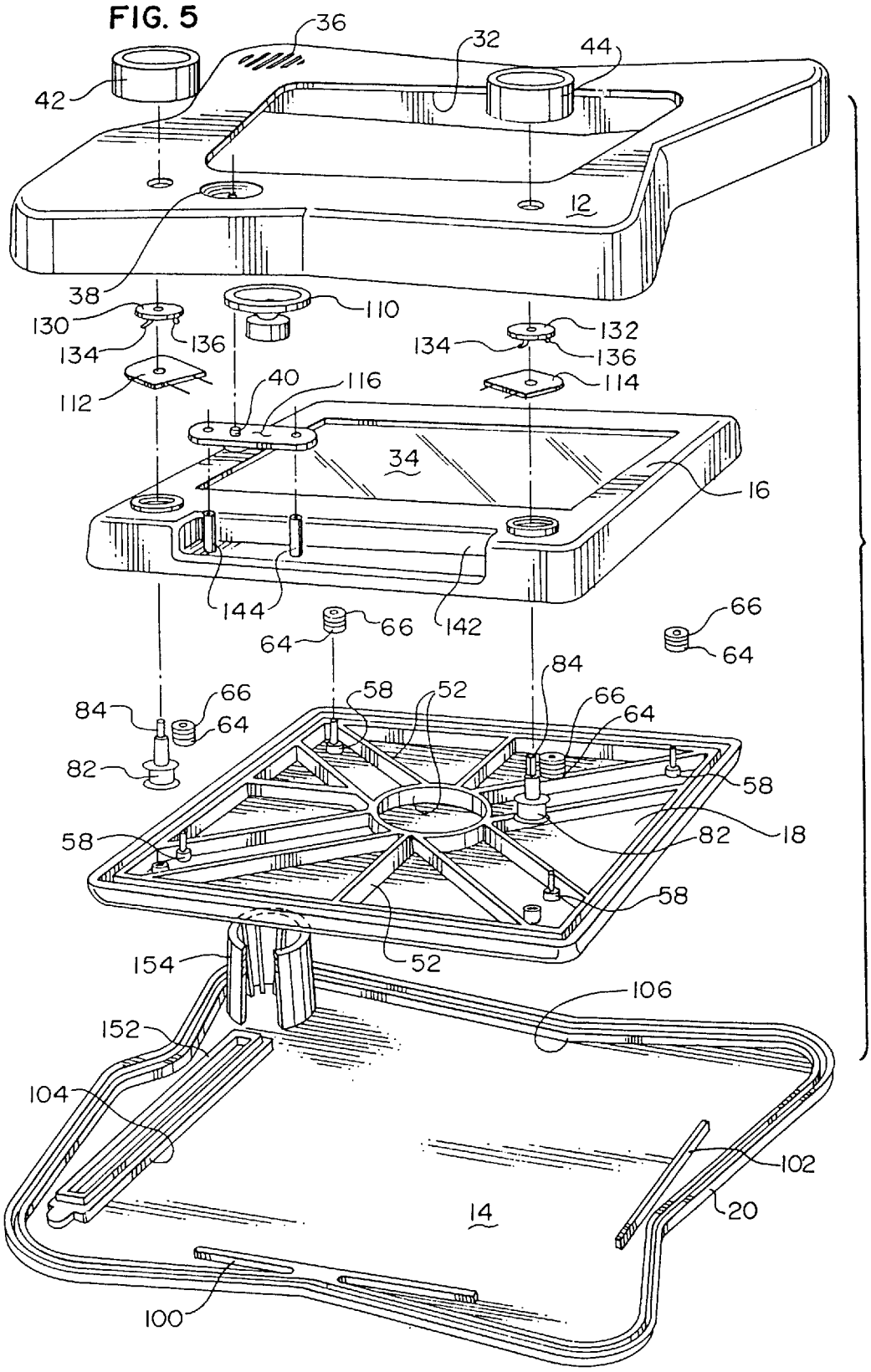
FIG. 5 is an exploded view of the present invention.

Referring again to FIG. 5, a pair of vertically raised flanges are integrally mounted on the upper surface of the inner cover to engage a side edge of the PC board 112 or 114 to prevent rotation thereof relative to the upper cover. In addition, a depression 142 is formed in the front wall of the inner cover and allow for the provision of two upwardly extending posts 144 which mount the main PC board 116. Suitable threaded fasteners are used to connect the main PC board 116 to the posts 144 so that a momentary type on-off switch button 40 extends into the depression 38 for selective actuation by the user. Also, a plurality of batteries are mounted within a generally rectangularly shaped battery compartment 152 on the inner base with its inner wall 104 engaging an edge of the inner base. The battery housing is formed in any suitable manner so that access can be obtained from the exterior of the assembly for removal and replacement of worn out batteries. Finally, a speaker support conical element 154 is provided on the outer base in the upper right corner thereof to support the speaker 110 in a position directly below the speaker grid 36 as described with respect to FIG. 1.

Figure 10:
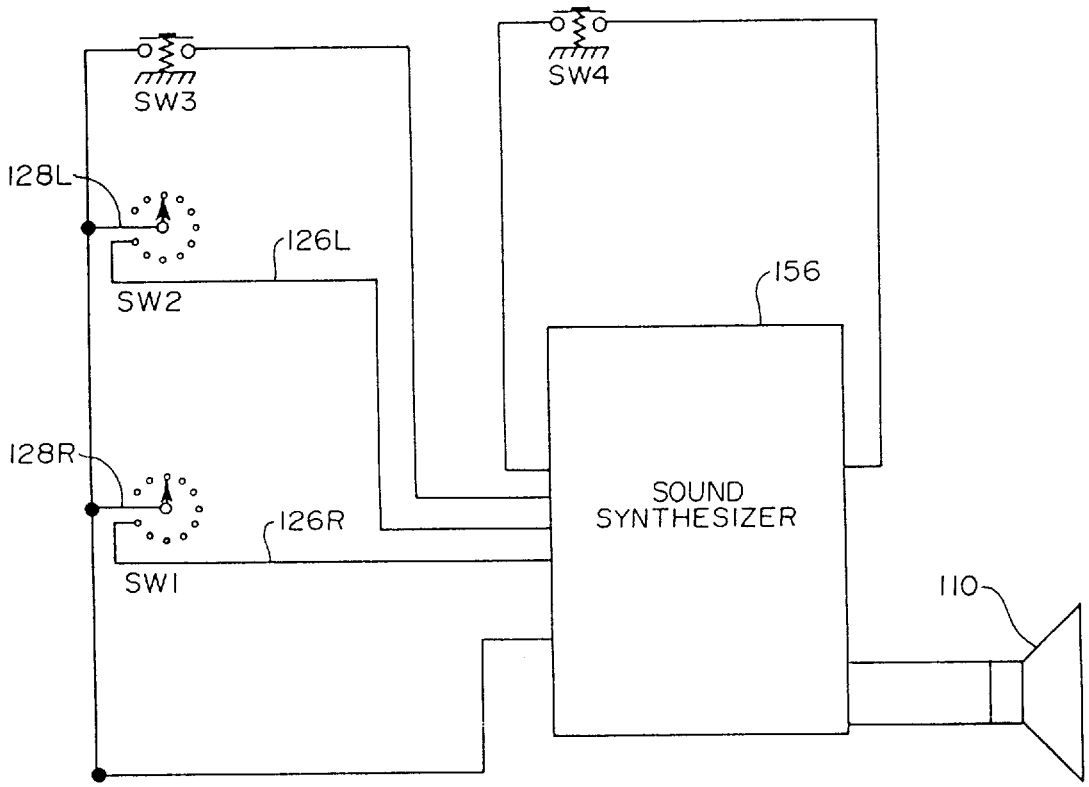
FIG. 10 is a schematic drawing showing the electrical and sound generating components of the present invention.

The connections between the rotary switches and other elements are shown in the functional diagram of FIG. 10. Referring to the schematic of FIG. 10, the rotary switch labeled SW1 represents that created by the right control knob 44 and SW2 represents the rotary switch created by the assembly of the left control knob 42. Momentary switch SW4 is a normally open switch used to power up, that is to turn on or turn off the sound synthesizer of the present invention. In particular, a sound synthesizer 156 is mounted on the PC board 116 and connected as shown to the batteries 150 and the switches SW1, SW2 SW3 and SW4 and the speaker 110 as shown. The sound synthesizer includes an integrated circuit such as a 160K bit power speech voice ROM which is commercially available for generating an output signal which is converted to audible sounds by the speaker 110.

The ROM is programmed in a conventional manner to provide a plurality of variable length outputs or sounds. As described previously, rotation of the control knobs 42 and 44 cause repeated connection of the rotary switches SW1 and SW2 which are connected to the synthesizer 156 which then, according to its programming, generates output sounds indicating the speed of rotation and, as described below, also a variety of "Easter eggs", or more simply "eggs", which generate an amusing, random unexpected output from the speaker when the rotary switches SW1 and SW2 remain stationary for a period of time. Although any number of sound synthesizer will be suitable, the Winbond W5280C and the T.I. 50C10 have been found to be a suitable selection. The gravity switch SW3, is mounted on the PC board 116 and operates as an erase switch to create a unique "erase" sound when erasing a previously drawn picture. Certain modifications and programming changes to create different sounds, longer, shorter, or more frequent sounds or eggs, would all be within the skill of an artisan. In this particular design, each of the rotary switches include 32 contacts per revolution and it is contemplated that interchangeable sound chips or cartridges could easily be designed and programmed to increase the variety and amusement generated by users of the invention.

The speech synthesizer 156 is programmed to provide an independent "erase" sound in certain situations. For example, when the user turns the drawing device 10 upside down, with the transparent upper surface 34 directed downwardly, the gravity switch SW3 is triggered, whereby the speech synthesizer initiates a signal to create an independent "erase" sound. Typically, in a drawing device of this type, the user inverts the drawing device and, in a second step, gently shakes the device 10 to smoothly and evenly coat the powder on the transparent surface 34 to create a new drawing. Therefore, instead of a normal gravity switch SW3 which closes one time when the device is inverted, it is possible to use an intermittent switch or a "jiggle" switch, which will open and close, depending upon vibratory movement of the drawing device 10. With this implementation, shaking of the drawing device to erase the old drawing and recoat the screen 34 with a layer of fluid, the jiggle switch SW3 will be caused to repeatedly open and close by the vibratory motion thereby causing the erase sound to be repeatedly restarted, thereby creating a combination of sequential "erase" sounds, depending upon the manner and speed at which the device is shaken.

The sound on-sound off switch, SW4, is also programmed to create a unique sound depending upon the state of the speech synthesizer. For example, when the off-on switch SW4 is activated, a particular, unique sound is emitted to indicate that the sound generation capabilities of the drawing device are in the "on" condition so that sound will be generated when the drawing device 10 is inverted for clearing the screen, or when the control knobs 42 and 44 are rotated. When the off-on switch is depressed again, a different, unique sound is emitted indicating that the enhancement of the drawing device is deactivated and no sounds will be admitted when the control knobs are actuated or when the unit is inverted for erasing.

The speech synthesizer is also programmed to provide feedback to the user as the rotary switches SW1 and SW2 are rotated. As described above, when the control knobs 42 and 44 are rotated, the contact finger 136 sweeps the outer contact elements 137 on the PC board. A connection is sequentially made and broken between the leads 126 and 128. The speech synthesizer is programmed to recognize this switching and to emit a sound each time a new contact is established. Therefore, depending upon the speed or rate of rotation of the respective control knob, the output of the sound, and therefore, the feedback to the operator, will increase in frequency as a function of the speed of the rotation of the knob. As presently contemplated, after the user stops rotating the knob, a different set or family of sounds is selected for the next time so that a different sound is generated when the user operates the knob again. Therefore, it is possible to generate distinct "clicking", "beeping", or other sounds, at different times during the rotation of the knobs, after the knob is at rest for a predetermined period of time. In addition, the sound synthesizer can also be programmed to create one sound or one of a family of sounds as the particular knob is rotated in the clockwise direction, and similarly a second sound or family of sounds when the knob is rotated in the opposite direction. Similarly, the opposite knob which controls movement of the cursor in the orthogonal direction can be programmed to create, for example, a third sound or family of sounds when rotated in a clockwise direction and a fourth sound or family of sounds when rotated in a counterclockwise direction. Therefore, the user will hear one sound grouping as the cursor moves up, a different sound grouping as the cursor moves down, another sound grouping as the cursor moves to the right, and yet another sound grouping as the cursor moves to the left. Of course, these combinations will be combined to create different sounds when combination lines are drawn at an angle, for example, or when making curved lines. Alternatively, it may be desirable to create a continuous sound as the respective knobs are rotated and the pitch of the sound could be changed in frequency to indicate the speed of rotation of the knob. This alternative could be implemented through the use of a resistive rotary switch or capacitive rotary switch as opposed to the segmented contact shown in FIG. 11.

In the preferred embodiment, a number of "Easter egg" sounds are generated after the knobs are rotated and then permitted to be in a stationary position. The sound synthesizer 156 may be programmed to select a sequence of sounds and to generate an audible sound as a combination of sound segments which are selected from those available in the families of sounds described above which is determined by the degrees of rotation of the respective knob, randomly or otherwise. Although, alternatively, the sounds could be separately generated continuous sounds of a predetermined length or duration.

Figure 8:
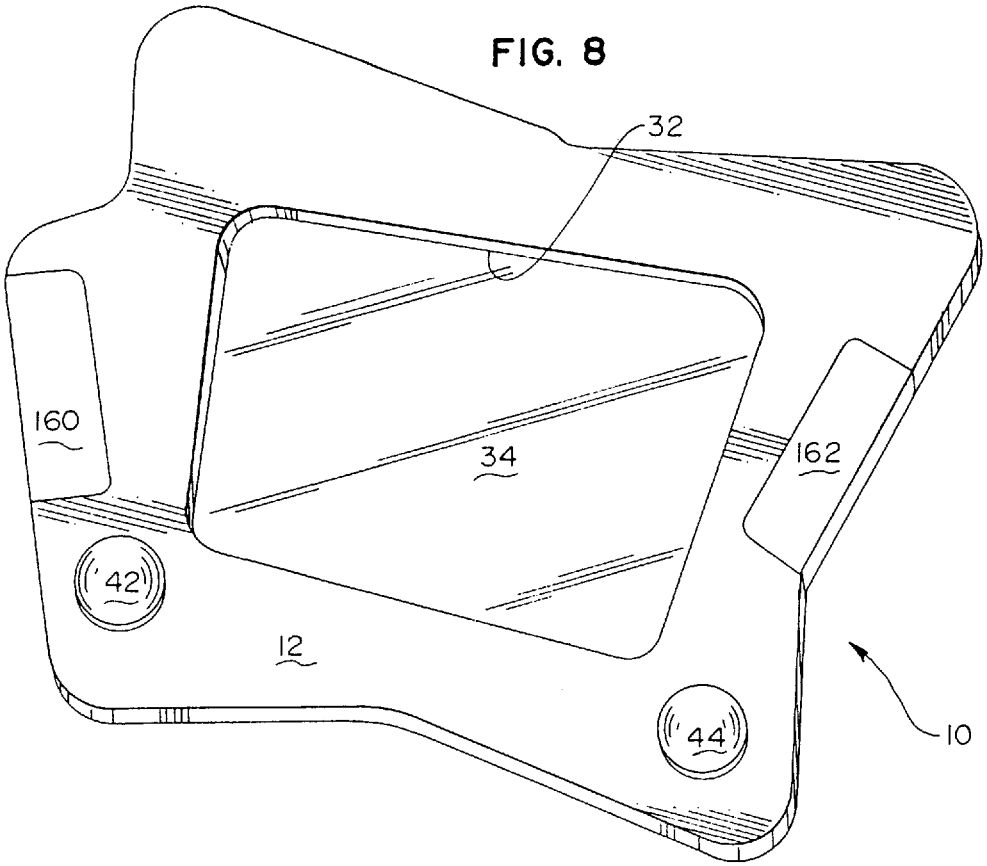
FIG. 8 is a perspective view of an alternate embodiment of an amusement device made in accordance with the present invention.
Figure 9:
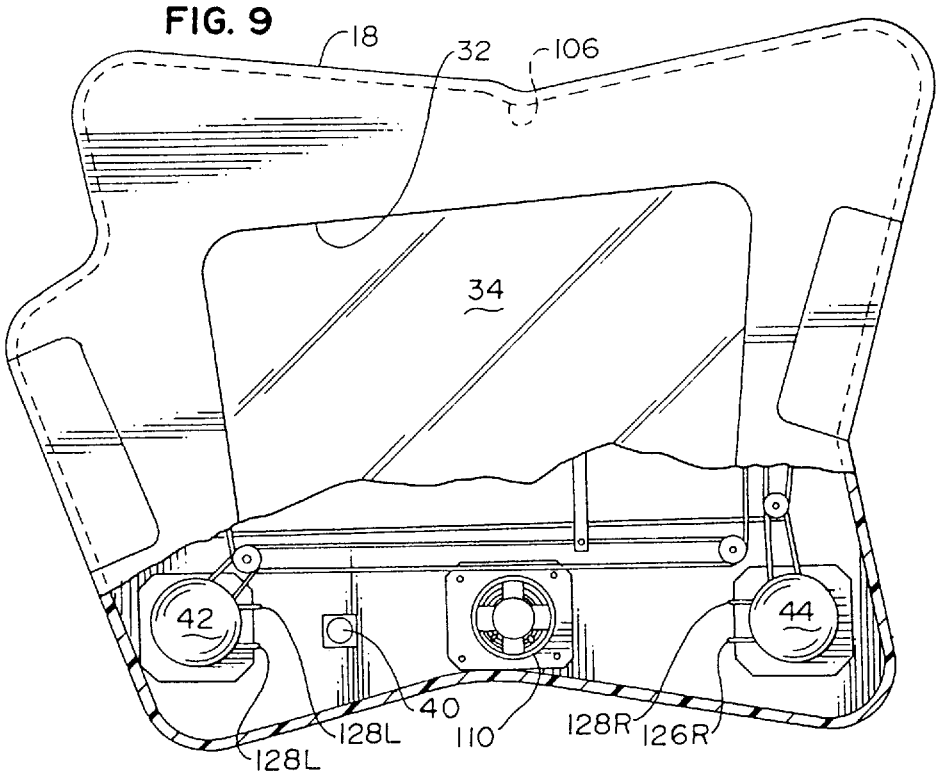
FIG. 9 is a top plan view of an alternate form of the amusement device of the present invention partially broken away to show the other features of the operating mechanism of the amusement device.

FIGS. 8 and 9 show a perspective view of an alternate embodiment of the amusement device of the present invention with a pair of gripping points 160 and 162 of possible different texture to facilitate holding the drawing device. The cutaway view of FIG. 9 of the alternate embodiment of the present invention shows separate pulley mounts to support the rod carrying filaments and the speaker 110 is shown to be mounted in a different location on the bottom of the housing. This embodiment is less complex since no inner container is provided and all of the operative elements are mounted directly to the outer shell. The design, as specifically described, as well as a substantial number of other designs, can be used and the foregoing detailed description should be understood as having been given for clearness of understanding only and no unnecessary limitations should be understood therefrom as many modifications would be obvious to those skilled in the art.

We claim:

1. A drawing device comprising:

a fluid-tight inner container having a transparent surface on one side thereof;

a fluid within the inner container for coating the inside surface of the transparent surface;

a stylus mounted within said container for movement to dislodge the fluid from said surface;

an outer compartment for enclosing said inner container, said outer compartment having an opening on one side;

means for aligning the transparent surface of the inner container with the opening in the outer container;

at least one control;

means operatively connecting the control to the stylus; and multimedia means for producing a user perceptible signal in response to operation of the control.

2. The drawing device of claim 1 wherein the means for aligning the transparent surface of the inner container with the opening in the outer container comprises at least one element integral with the outer compartment for engaging the exterior of the inner compartment.

3. The drawing device of claim 2 wherein the means for aligning the transparent surface comprises a plurality of upstanding ribs molded integrally with the outer compartment.

4. The drawing device of claim 3 wherein the means for aligning the transparent surface further includes a battery compartment formed integrally with the outer compartment.

5. The drawing device of claim 1 wherein the multimedia means includes a sound synthesizer for creating an audio signal in response to movement of the control.

6. The drawing device of claim 5 wherein the control includes a pair of rotatably mounted control knobs and switch means associated with each control knob to generate an audio signal in response to rotation of one of the control knobs.

7. The drawing device of claim 6 wherein each switch means knob includes a rotary switch mounted between the inner container and the outer compartment for conjoint rotation with the control knob.

8. The drawing device of claim 7 wherein each switch includes a movable wiper and a stationary element having a plurality of contacts engageable by said wiper.

9. The drawing device of claim 1 wherein the multimedia enhancement includes means for generating a predetermined user perceptible signal in response to inversion of the drawing device.

10. The drawing device of claim 9 wherein the means for generating said predetermined signal is a gravity switch.

11. The drawing device of claim 9 wherein the means for generating said predetermined signal is a momentary contact switch.

12. A drawing device comprising:

at least one user operable control element for moving a stylus about a drawing surface, and multimedia means for generating a user perceptible signal in response to at least several of a plurality of user operations of the control element.

13. The drawing device of claim 12 wherein the multimedia means includes a sound synthesizer, and wherein the user perceptible signal indicates the rate of operation of the control element.

14. The drawing device of claim 13, further including a pair of control elements and wherein the user perceptible signal indicates the rate and direction of the movement of the control elements.

15. The drawing device of claim 12 wherein the multimedia means includes means for generating said user perceptible signal after the control element has been at rest for a period of time.

16. The drawing device of claim 15 wherein the multimedia means further generates a second unique user perceptible signal representing an erase sound upon inversion of the drawing device.

17. The drawing device of claim 16 wherein the multimedia means further repetitively generates said erase sound upon vibration of the drawing device.

18. A multimedia enhancement for a drawing device having at least one control element for moving a stylus about a drawing surface, the enhancement comprising:

means for generating a user perceptible signal in response to at least several of a plurality of operations of the control element.

19. The multimedia enhancement of claim 18, wherein the means for generating said user perceptible signal includes a sound synthesizer, and wherein the signal indicates the rate of operation of the control element.

20. The multimedia enhancement of claim 19, wherein the signal indicates further the direction of operation of the control element.

21. The multimedia enhancement of claim 19, wherein the sound synthesizer generates a further signal indicating that the device has been gravitationally inverted.

22. The multimedia enhancement of claim 19, wherein the sound synthesizer generates a further signal indicating that the control knob has been stationary for a period of time.

* * * * *